United States Patent [19]

Robertson

[11] Patent Number: 4,633,788

[45] Date of Patent: Jan. 6, 1987

[54] DISPLAY UNIT

[75] Inventor: James D. Robertson, Atlanta, Ga.

[73] Assignee: The Mead Corporation, Dayton, Ohio

[21] Appl. No.: 770,695

[22] Filed: Aug. 29, 1985

[51] Int. Cl.[4] ..... A47B 9/00

[52] U.S. Cl. ..... 108/108; 108/111; 211/189

[58] Field of Search ..... 108/108, 111, 23, 27, 108/8; 211/187, 189, 59.4, 188, 184, 186, 193, 135

[56] References Cited

U.S. PATENT DOCUMENTS

| | | | |
|---|---|---|---|
| 1,602,410 | 10/1926 | Hamblin | 108/111 |
| 2,999,599 | 9/1961 | Jentzen | 108/23 |
| 3,040,848 | 6/1962 | Powell et al. | 108/108 X |
| 3,217,667 | 11/1965 | Patterson | 108/23 |
| 3,229,790 | 1/1966 | Shayne | 108/111 X |
| 3,602,159 | 8/1971 | Marschak | 108/111 |
| 4,148,533 | 4/1979 | Bustos et al. | 108/23 X |
| 4,344,367 | 8/1982 | Merl | 108/8 X |
| 4,415,090 | 11/1983 | Bustos | 211/59.4 |
| 4,472,076 | 9/1984 | Toft, Jr. et al. | 108/111 X |

FOREIGN PATENT DOCUMENTS

| | | | |
|---|---|---|---|
| 206057 | 10/1955 | Australia | 108/108 |

*Primary Examiner*—Peter A. Aschenbrenner
*Assistant Examiner*—Jose V. Chen
*Attorney, Agent, or Firm*—Rodgers & Rodgers

[57] ABSTRACT

A display stand having a base and a back extending upwardly from the base together with a plurality of vertically spaced shelves secured to the back of the stand is attached along one side thereof to a wing unit having a wing base and a wing back extending upwardly from the base together with a divider wall extending upwardly from the wing base and disposed immediately adjacent the display stand together with a header unit overlying the display stand and the wing unit and including an outer generally U-shaped peripheral structure the prongs of which are secured to upper parts of the back and of the wing back which are remote from each other, the header unit including a generally horizontal translucent structure supported by the peripheral structure and parts of the peripheral structure being translucent and other parts constituting sign boards.

16 Claims, 10 Drawing Figures

DISPLAY UNIT

TECHNICAL FIELD

This invention relates to display devices for primary packages such as bottled soft drinks and related or associated products and is for use in displaying such objects in retail outlets.

BACKGROUND ART

U.S. Pat. No. 4,314,648 issued Feb. 9, 1982 and owned by the assignee of this invention discloses and claims a display stand having a base and a back extending upwardly therefrom together with a plurality of shelves supported by the back and arranged in vertically spaced relation one above another.

DISCLOSURE OF THE INVENTION

According to this invention in one form, a display stand including a base and a back extending upwardly therefrom together with a plurality of vertically spaced shelves secured to the back is secured along one side thereof to a wing unit which includes a wing base and a wing back extending upwardly from the base together with a divider wall extending upwardly from the wing base together with a header unit overlying the display stand and the wing unit and including an outer generally U-shaped peripheral structure parts of which are of translucent material and parts of which constitute sign boards, the prongs of the U-shaped header unit being secured to upper parts of the back of the display stand and of the wing back which are remote from each other.

BEST MODE OF CARRYING OUT THE INVENTION

Figure 1:
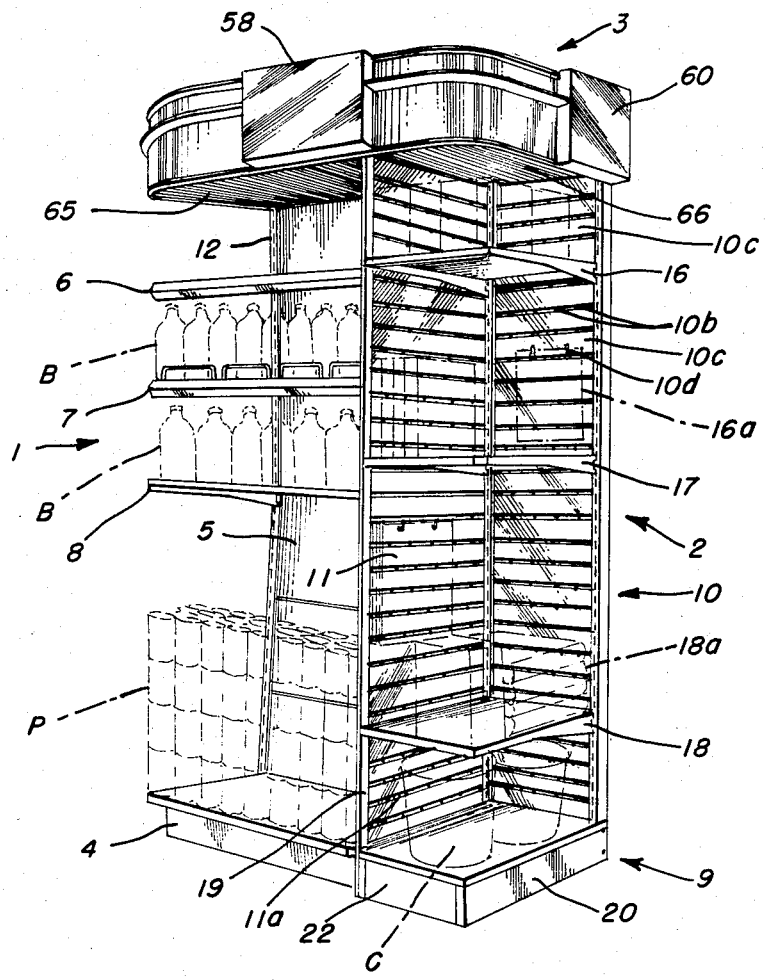
FIG. 1 is a perspective view of a display unit formed according to this invention.

With reference to FIG. 1 the numeral 1 generally designates a display stand of conventional construction and the numeral 2 generally designates a wing unit disposed along one side of the display stand identified by the reference numeral 1. Header structure which overlies both the display stand 1 and the wing unit 2 is designated generally by the numeral 3.

The display stand 1 comprises a base 4 and a back 5 extending upwardly from the base 4 together with a plurality of shelves 6, 7 and 8 which are secured to portions of the back 5. Bottles "B" are shown displayed on shelves 7 and 8 and packages "P" are shown mounted on base 4.

The wing unit 2 includes a wing base 9 and a wing back 10 extending upwardly from the wing base 9 together with a divider wall 11 which extends upwardly from wing base 9 and forms a part of wing unit 2. Display stand 1 and wing unit 2 are secured together.

Figure 2:
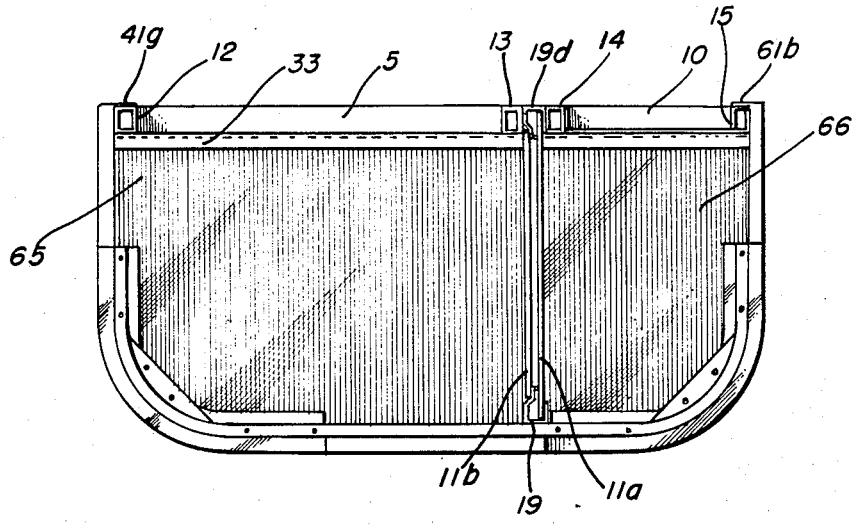
FIG. 2 is a plan view from above of the structure shown in FIG. 1 with certain parts removed.

As is apparent particularly from FIG. 2, display stand 1 includes a pair of vertically disposed uprights 12 and 13 which form portions of the back wall 5 and which are provided with apertures for disjointably receiving parts of the shelves such as 6, 7 and 8. Wing unit 2 includes a pair of spaced vertically disposed uprights 14 and 15 which form parts of the wing back of wing unit 2 and which include apertures for disjointably receiving portions of shelves 16, 17 and 18.

Figure 7:
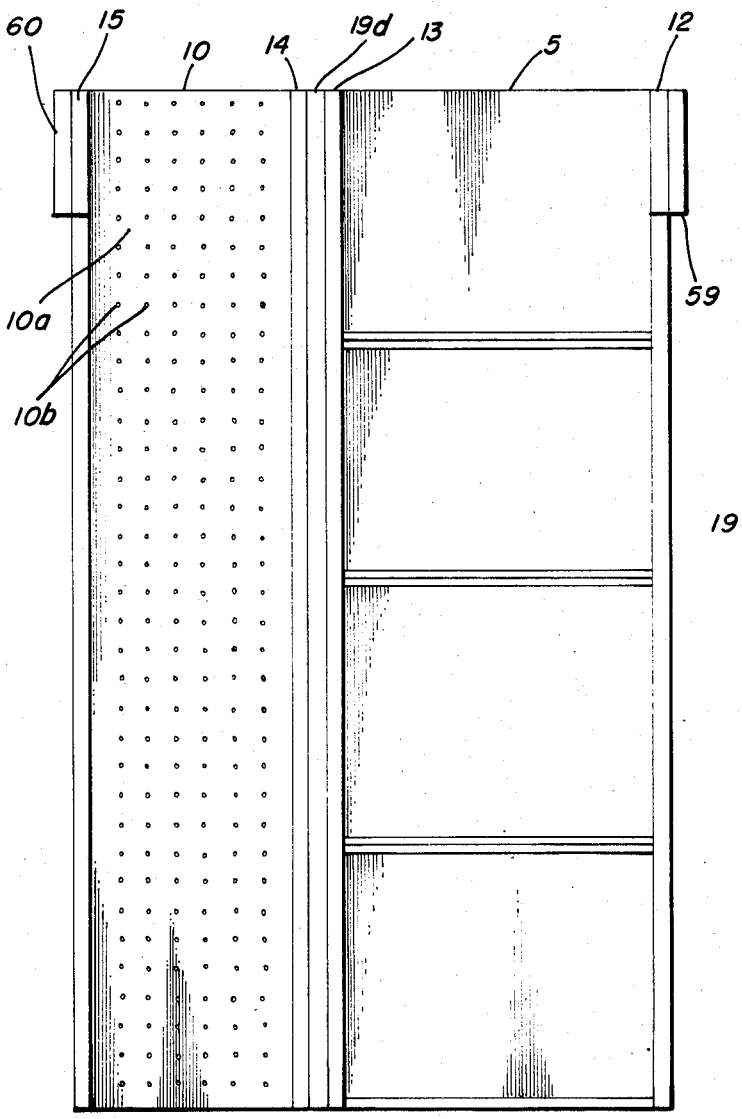
FIG. 7 is a view from the rear of the structure shown in FIG. 1.
Figure 8:
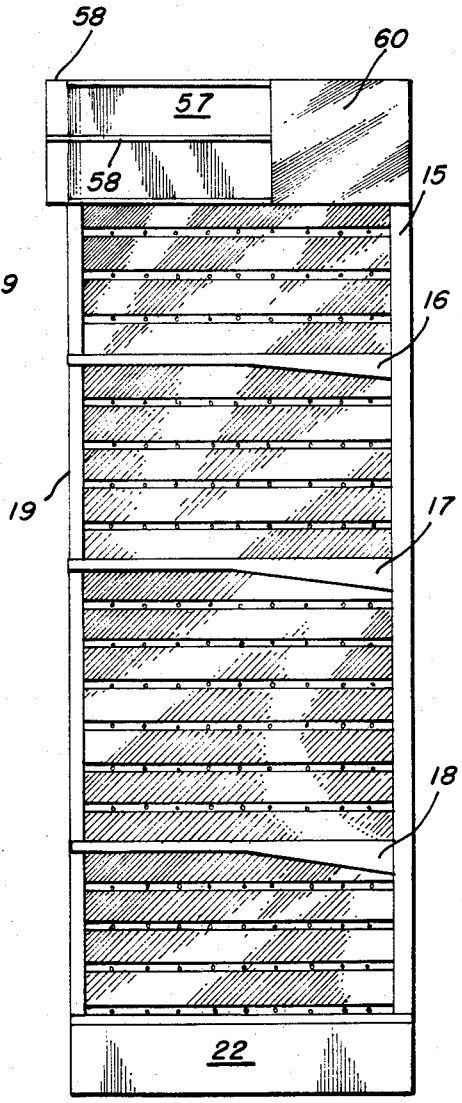
FIG. 8 is a view of the structure shown in FIG. 1 from the near side thereof which shows the wing unit and the header as viewed from the side.
Figures 9, 10:
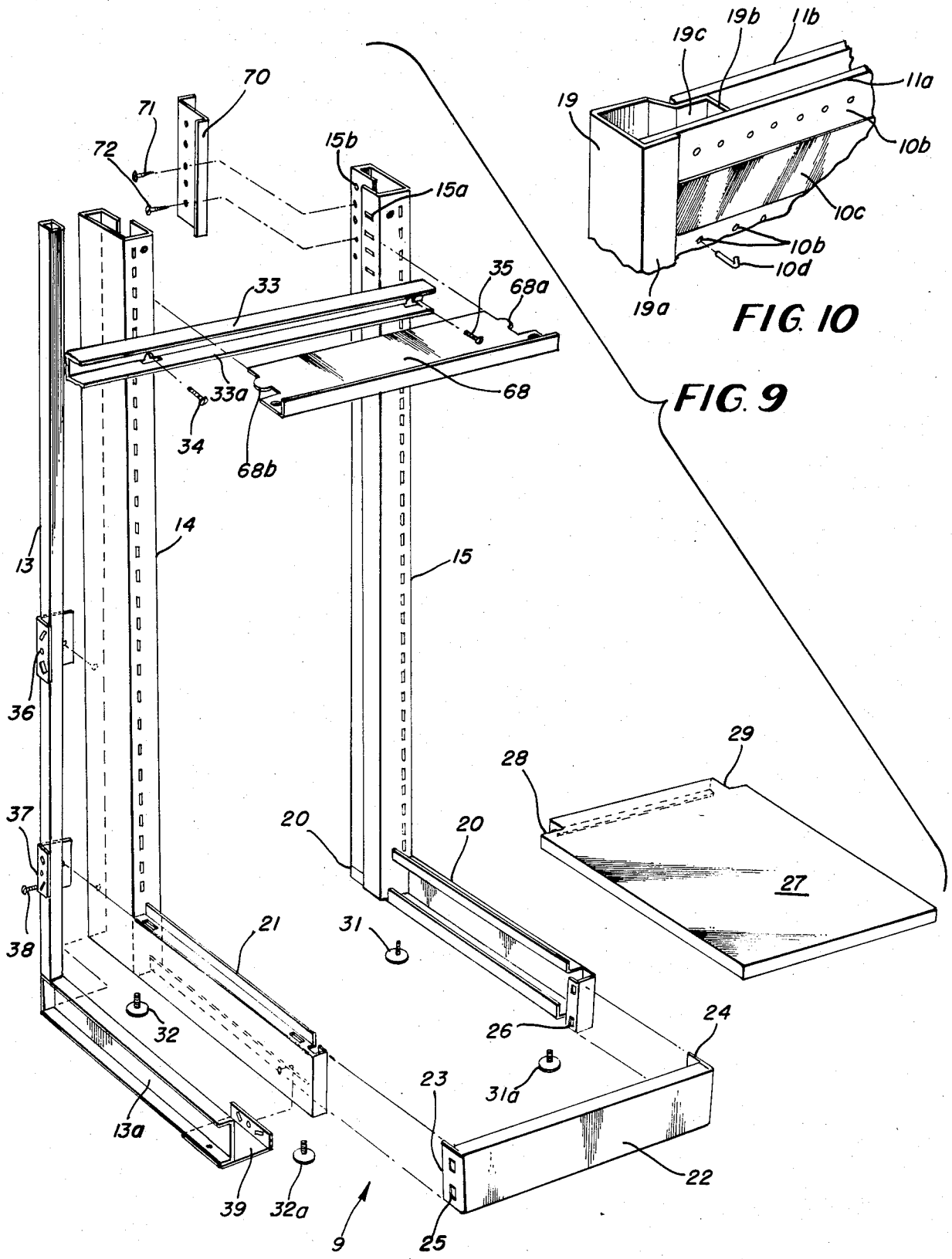
FIG. 9 is an exploded view of certain structural components of the wing unit.
FIG. 10 is a fragmentary perspective view of the upper front corner of the divider wall which is secured to the near side of the wing unit as the wing unit is observed in FIG. 9.

The pegboard **10*a* which forms a part of the back 10 and which is secured to uprights 14 and 15 includes a plurality of holes 10*b* as best shown in FIGS. 1 and 7. These holes 10*b* receive removable pegs such as are indicated 10*d* in FIG. 1 and serve as disjointable hangers on which various items such as the packet 16*a* shown in phantom lines may be secured. Divider wall 11 is secured along its front edge to upright 19 and at its rear edge to upright 19*d*. Uprights 19 and 19*d* are of similar construction. The entire wall is interposed between upright 13 of display stand 1 and upright 14 of wing unit 2 as is apparent from FIG. 2. As is best shown in FIG. 10 upright 19 is specially configured and serves to receive the pegboard 11*a* between the channel flange 19*a* and the inwardly projecting flange 19*b*. The board 11*b* is secured by suitable means to the flange element 19*c*. Interposed between the rows of peg holes 10*b* are horizontally disposed strips 10*c* which are preferably formed of suitable reflecting plastic material whereby the appearance of displayed items is substantially improved. Pegs 10*d* may be mounted in any desired hole 10*b* for supporting displayed items against divider wall 11**.

As is best shown in FIG. 9 the wing base 9 includes a pair of transversely spaced side supports 20 and 21 which are of special configuration as shown in FIG. 9. A front kick plate 22 is provided with inturned end portions 23 and 24 having openings such as 25 which cooperate with complementary openings such as 26 and suitable fasteners to secure the kick plate 22 in position at the front of the wing unit. A base board 27 is mounted atop the side supports 20 and 21 with its back corner 28 disposed adjacent the upright 14 and with its back corner 29 disposed adjacent the upright 15.

Adjustable feet for the wing unit are provided and include threaded element 31 and **31*a* which threadedly engage a lower surface of support 21 together with threaded feet 32 and 32*a* which threadedly engage a lower surface of support 21. Adjustment of the feet 31, 31*a*, 32 and 32*a*** is effected in an obvious manner.

The display stand 1 and the wing unit 2 are secured together by means of cross bar 33 which is secured to uprights 14 and 15 by suitable means such as bolts 34 and 35 as best shown in FIG. 9. Cross bar 33 is similarly secured to uprights 12 and 13 as shown in FIG. 2. Upright 13 is secured to upright 14 by means of L-shaped brackets 36 and 37, these brackets being secured to upright 13 by any suitable means such as by the bolt 38 and also being secured to the upright 14 in a similar manner as indicated schematically in the exploded view designated as FIG. 9. In addition, bracket 39 is similarly secured to support 21 and to the horizontal support 13*a* to which the upright 13 is secured in any suitable known manner.

The header structure as shown in FIGS. 3, 4, 5 and 6 includes a front plate 40 having upper flange 40*a* and lower flange 40*b* together with side plate 41 having upper flange 41*a* and lower flange 41*b*. Front plate 40 and side plate 41 are interconnected by means of diagonal corner brackets 42 and 43. Corner bracket 42 is provided with end tabs 42*a* and 42*b* while corner bracket 43 is provided with end tabs 43*a* and 43*b*. Tabs 42*a* are inserted into apertures 41*c* in side plate 41 while end tabs 42*b* are inserted into apertures 40*c*. Tabs 43*a* are inserted into apertures 41*d* while tabs 43*b* are inserted into apertures 40*d*. Once these tabs 42 and 43 are inserted into their associated apertures they are bent into overlapping contact with the outer surface of front plate 40 and side plate 41.

Figure 5:
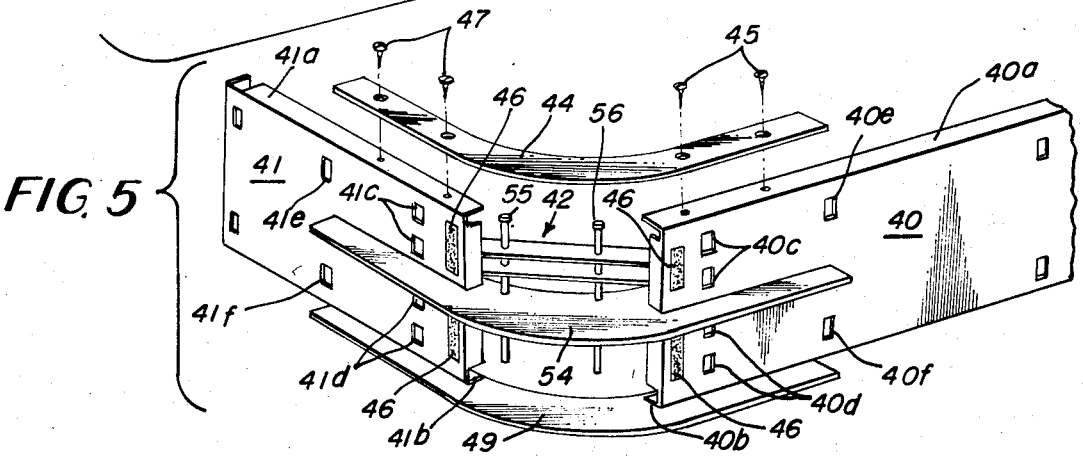

As best shown in FIG. 5, rounded corner strip 44 is secured by fasteners 45 to the upper flange 40*a* of front plate 40 and by fastening devices 47 to the upper flange 41*a* of side plate 41.

In like fashion rounded corner strip 49 is similarly secured to the lower flange 41*b* of side plate 41 and to lower flange 40*b* of front plate 40.

Figure 6:
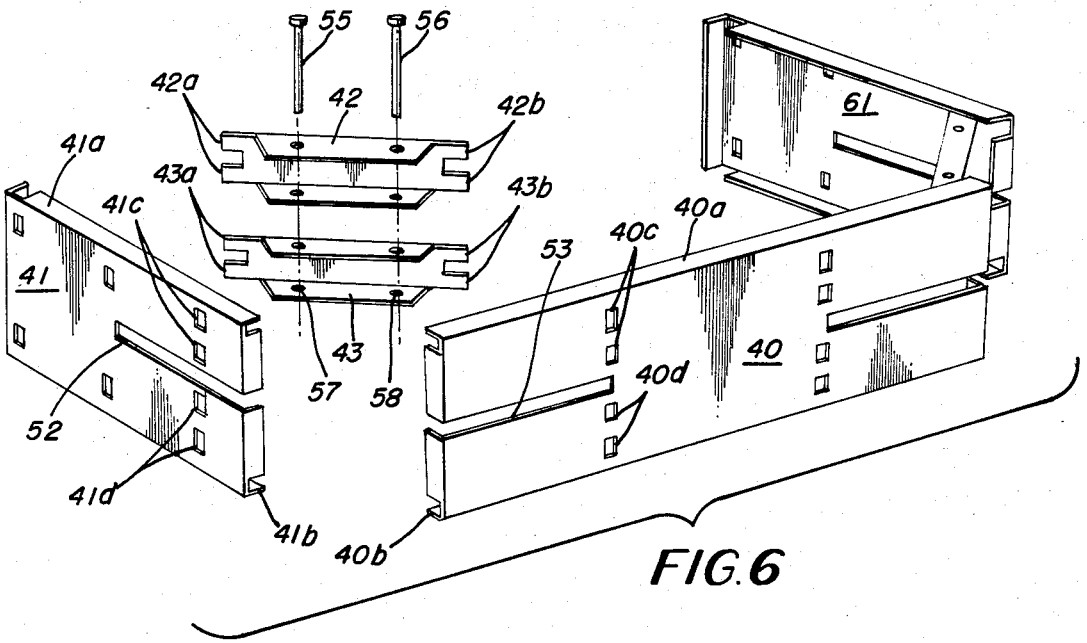

As is best seen in FIG. 6, a longitudinal medial slot 52 is formed in side plate 41 while a similar longitudinal medial slot 53 is formed in an end portion of front plate 40. These slots 52 and 53 receive the end portions of rounded translucent plastic strip 54. This rounded strip 54 is held in place by pins 55 and 56 which extend through aligned openings such as 57 and 58 formed respectively in corner brackets 42 and 43 as is best shown in FIG. 6. It is apparent that these pins 55 and 56 extend through corresponding openings formed in corner translucent strip 54 as is shown in FIGS. 4 and 5.

Figure 3:
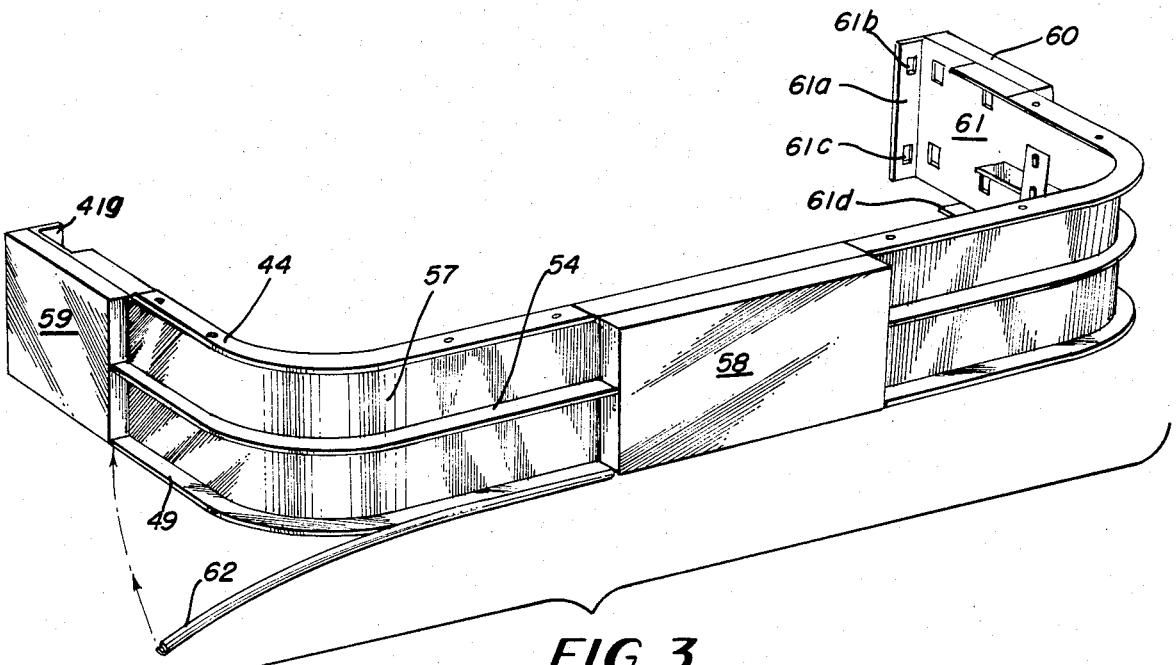
FIG. 3 is an overall perspective view of a header unit formed according to this invention.
Figure 4:
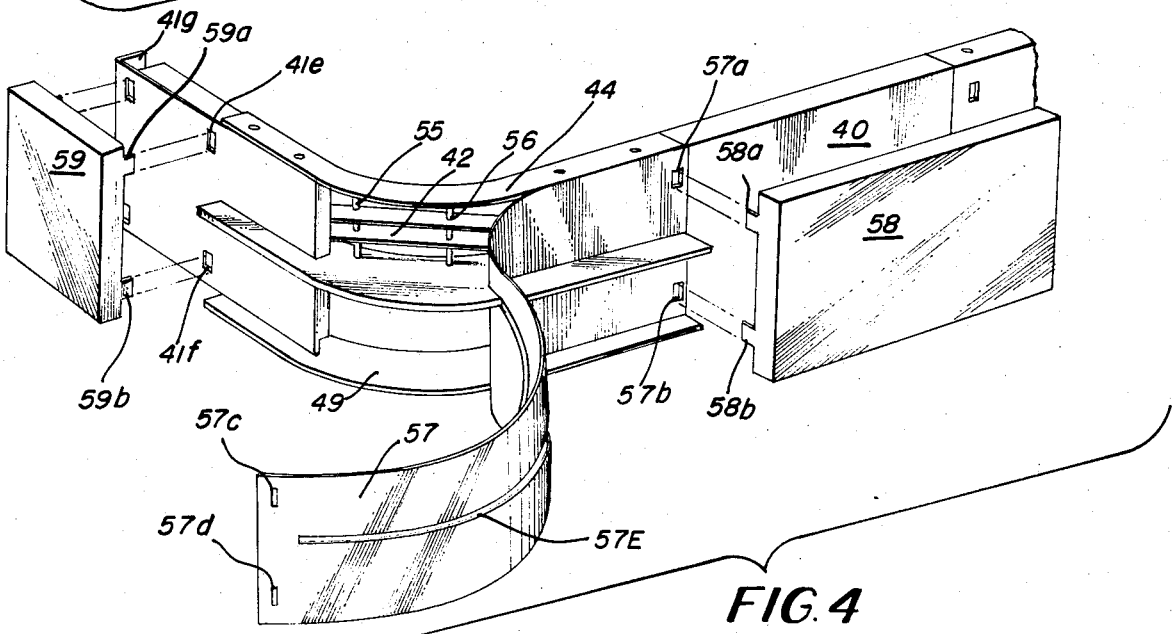
FIGS. 4, 5 and 6 are partial views of the structure shown in FIG. 3 with parts removed or broken away for simplicity.

In order to enhance the appearance of the corner portions of the peripheral header, a flexible translucent sheet of plastic material designated by the numeral 57 is provided and includes a medial longitudinal slot 57*e* as is best shown in FIG. 4. Longitudinal slit 57*e* receives the rounded strip of translucent plastic material 54 when the strip 57 is manipulated into its final position as shown in FIG. 3. The front end of strip 57 is provided with apertures 57*a* and 57*b*. These apertures receive projecting tabs 58*a* and 58*b* of front sign 58. Tabs 58*a* and 58*b* extend through openings 40*e* and 40*f* formed in front plate 40 so as to clamp the adjacent end of sheet 57 between front plate 40 and sign 58.

In like fashion the holes 57*c* and 57*d* of strip 57 receive tabs 59*a* and 59*b* of sign 59. Tabs 59*a* enter holes 41*e* and 41*f* formed in side plate 41 so that the left hand end of sheet 57 is clamped firmly in position between sign 59 and side plate 41.

In order to insure that strip 57 is held snugly against front plate 40 and side plate 41 double faced tape 46 may be provided as shown in FIG. 5.

In order to improve the appearance of rounded corner strips 44 and 49 a trim strip 62 as best shown in FIG. 3 may be provided and is channel shaped so as to envelop the outer edge of the corner strips 44 and 49, one trim strip 62 being shown in its partially installed position.

The corner of the header which is disposed between the front plate 40 and the side plate 61 is identical in construction to the corner structure which is interposed between front plate 40 and side plate 41.

The header structure is mounted atop the display unit by means of the plate 61*a* which forms a part of side plate 61 by securing that plate to upright 15. This is accomplished by suitable fasteners inserted through the apertures 61*b* and 61*c* formed in plate 61*a* and through appropriate apertures formed in the back side of upright 15. At the other extremity of the header, a plate 41*g* is secured to the rear surface of upright 12 in a manner such as is described in connection with plate 61*a*. Of course the upright 19 is disposed underneath the front part of the header adjacent the right hand edge of sign 58 and affords substantial support for the header.

In order to enhance the appearance of displayed items, a light diffuser panel 65 is mounted within the header and above display stand 1 while a light diffuser panel 66 is mounted within the header above the wing stand 2. The front edge of diffuser 65 is supported by lower flanges 41*b* of the side plate 41 and lower flange 40*b* of front plate 40 while the rear edge of diffuser panel 65 is supported by the cross bar 33. The front edge of diffuser panel 66 is supported by lower flange 40*b* of front plate 40 and the side edge of diffuser 66 is supported by lower flange 61*d* of side plate 61. The rear edge of diffuser 66 is supported by plate 68 which is secured to uprights 14 and 15 as best shown in FIG. 9 by means of end tabs 68*a* and 68*b*. Tab 68*a* enters an appropriate one of the four apertures in upright 15 designated by the numeral 15*a* while tab 68*b* is received within similar apertures formed along the inner surface of upright 14. Of course plate 68 may be lowered or raised so as to accommodate various height requirements for the diffuser panel 66 as may be required in particular instances.

In order to accommodate variations in height requirements for the upright 15 relative to the uprights 12 and 13 of the display stand, an auxiliary extension bracket 70 is provided. This bracket as is best shown in FIG. 9 is secured in an appropriate manner by fastening to apertures 15*b* formed along the inner surface of upright 15 so that the effective height of upright 15 may be increased by varying amounts as ma be required. Bracket 70 is secured to upright 15 by suitable fastening means 71 and 72 which cooperate with bracket 70 and upright 15 as indicated by the dotted lines in FIG. 9.

Preferably the translucent plates 65 and 66 should be of corrugated construction and formed of polypropylene. These diffuser plates, plastic sheet 57, corner rounded strip 54, together with the mirrors formed on divider wall 19 and on wing back 2 identified by the numeral 10*c* greatly enhance the light level in the region where the displayed items are located particularly if the light level above the display unit is bright.

The unit according to this invention is well suited for use by a vendor of items such as might be packaged in the bottles B or in packages P and whose trademark may appear on other items such as containers C shown in phantom lines and mounted on base 20 of the wing unit 2 or such as carrying bags generally designated by the letter 18*a* in FIG. 1 and disposed on shelf 18 and shown in phantom lines or by the pamphlets designated 16*a* and shown in phantom lines in FIG. 1 and suspended by pegs 10*d* which are removable and are disposed in a hole such as 10*b* in peg board 10*a*. Of course the shelves 16, 17 and 18 can be removed or used in FIG. 1 because these shelves are disjointably mounted at the rear portions thereof to the uprights 14 and 15.

The invention may be practiced according to the unit shown in FIG. 1. In addition, if desired, a wing unit similar to wing unit 2 may be secured to the opposite side of display stand 1 with appropriate changes in design of the wing unit 2. Furthermore, the unit may be used as an end aisle display as shown in FIG. 1 or if desired a unit such as is shown in FIG. 1 can be placed back to back with another similar unit to form an island display if floor space is adequate for such application of the invention.

INDUSTRIAL APPLICABILITY

A display unit formed according to this invention is well suited for all channels of distribution such as food stores, mass merchandisers and department stores. It is especially well suited for use by a vendor who wishes to display a number of different but related products which may have the vendor's trademark applied thereto and of course the sign boards provided according to this invention afford an opportunity for display of the vendor's trademark.

I claim:

1. A display unit comprising a display stand having a base and a back extending upwardly from said base, a wing unit secured to one side of said display stand and having a wing base and a wing back extending upwardly from said wing base, and a header unit overlying said display stand and said wing unit and including an outer generally U-shaped peripheral structure having prongs which are secured to upper parts of said back and of said wing back which are remote from each other and which includes a pair of rounded corner portions each interconnecting adjacent ends of a front and a side plate which are disposed in normal relation to each other and wherein end portions of a diagonal corner bracket are interconnected with adjacent ends of said front and side plates and wherein adjacent ends of said front and side plates include longitudinal medial slots and wherein a rounded strip of translucent plastic material is arranged with its ends disposed in said slots respectively.

2. A display unit according to claim 1 wherein said wing back includes disjointable support means for engaging and displaying point of purchase products.

3. A display unit according to claim 1 wherein said wing back includes reflective areas for enhancing the appearance of displayed items.

4. A display unit according to claim 1 wherein said wing back includes a pair of spaced uprights and wherein a plurality of shelves are disjointably secured to said uprights.

5. A display unit according to claim 1 wherein said header unit includes a planar light diffuser mounted on an supported by inwardly projecting portions of said outer peripheral structure and of said back and of said wing back.

6. A display unit according to claim 5 wherein said planar light diffuser comprises corrugated polypropylene.

7. A display unit according to claim 1 wherein said front and side plates include upper and lower flanges and wherein rounded strips are interconnected at their ends with adjacent ends of said upper and lower flanges of said front and side plates respectively.

8. A display unit according to claim 7 wherein flexible trim strips are secured to said rounded strips respectively in overlying relation therewith.

9. A display unit according to claim 1 wherein a flexible translucent sheet of plastic material includes a medial slot for receiving said rounded strip of translucent material and wherein the ends of said flexible translucent sheet of plastic material are secured to adjacent ends of said side and end plates.

10. A display unit according to claim 9 wherein the ends of said flexible translucent sheet of plastic material are secured to adjacent ends of said side and end plates by means of sign boards secured to said side and end plates for clamping the ends of said sheet of flexible plastic material therebetween.

11. A display unit according to claim 9 wherein double face tape is interposed between said translucent sheet of plastic material and the adjacent ends of said front and side plates.

12. A display unit according to claim 1 wherein said rounded strip of flexible translucent material is mechanically connected with said diagonal corner bracket.

13. A display unit according to claim 12 wherein said rounded strip of flexible translucent material and said diagonal corner bracket include aligned holes in which elongated pins are disposed.

14. A display unit according to claim 1 wherein a divider wall is interposed between said wing unit and said one side of said display stand and disposed in generally perpendicular relation to said back and to said wing back.

15. A display unit according to claim 14 wherein said divider wall includes disjointable support means for engaging and displaying point of purchase products.

16. A display unit according to claim 14 wherein said divider wall includes reflective areas for enhancing the appearance of displayed items.

* * * * *